US006477343B1

(12) United States Patent
Takeuchi et al.

(10) Patent No.: US 6,477,343 B1
(45) Date of Patent: Nov. 5, 2002

(54) IMAGE FORMING METHOD AND APPARATUS WITH MEANS FOR REDUCING THE ACCUMULATION OF PARTICLE ON A CHARGING DEVICE

(75) Inventors: Takami Takeuchi, Nagoya (JP); Yoshinori Endo, Toyota (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/660,545

(22) Filed: Sep. 12, 2000

(30) Foreign Application Priority Data

Sep. 30, 1999 (JP) ..... 11-280524
Sep. 30, 1999 (JP) ..... 11-280525

(51) Int. Cl.[7] ..... G03G 15/02; H01T 19/04; H05F 3/00

(52) U.S. Cl. ..... 399/100; 250/325; 361/229; 399/50

(58) Field of Search ..... 399/50, 100, 170; 361/229, 230; 250/324, 325, 326

(56) References Cited

U.S. PATENT DOCUMENTS 5,426,487 A * 6/1995 Stelter et al. ..... 399/50 X
5,612,768 A * 3/1997 Kim et al. ..... 399/100 X
5,742,874 A * 4/1998 Koshimura et al. ..... 399/100
5,835,821 A * 11/1998 Suzuki et al. ..... 399/100
6,122,460 A * 9/2000 Meece et al. ..... 399/50 X

FOREIGN PATENT DOCUMENTS

| | | | |
|---|---|---|---|
| JP | 63-127269 | * | 5/1988 |
| JP | 4-63368 | * | 2/1992 |
| JP | 4-366976 | * | 12/1992 |
| JP | 6-130770 | * | 5/1994 |
| JP | 9-114335 | * | 5/1997 |
| JP | 10-123889 | * | 5/1998 |

* cited by examiner

*Primary Examiner*—Fred L Braun
(74) *Attorney, Agent, or Firm*—Oliff & Berridge, PLC

(57) ABSTRACT

An image forming method and apparatus, wherein the charging amount that a charging device charges a photosensitive drum is controlled so as to reduce the charging amount in a period, except for the image forming period, than that during the image forming period. While the charging amount is reduced, the voltage applied to the charging device is controlled by chopping. Accordingly, mote adhesion onto the charging device and improper chopping can be effectively prevented or reduced. When print data is input from an outside source, the quantity of airflow generated by the fan is allowed to increase, and the printing operation starts after the quantity of airflow is increased. As sufficient airflow is generated inside the laser printer before the charging device starts to charge, motes and other objects existing in the laser printer can be ejected outside effectively. As a result, mote adhesion onto the charging device and improper charging can be prevented or reduced.

22 Claims, 11 Drawing Sheets

IMAGE FORMING METHOD AND APPARATUS WITH MEANS FOR REDUCING THE ACCUMULATION OF PARTICLE ON A CHARGING DEVICE

BACKGROUND OF THE INVENTION

1. Field of Invention

The invention relates to an image forming apparatus that forms an image by supplying and adhering toner onto a photosensitive drum on which an electrostatic latent image is formed to visualize the electrostatic latent image.

2. Description of Related Art

In a conventional image forming apparatus having a developing device that uses a non-magnetic one-component agent, toner is accommodated in a toner chamber. The toner is supplied to a developing roller, which carries the toner to a photosensitive drum. When the toner is supplied to the photosensitive drum, an electrostatic latent image formed on the drum is visualized as a toner image. When the visualized toner image is transferred onto a paper to be printed, characters or images are formed on the paper.

To form the electrostatic latent image on the photosensitive drum in such an image forming apparatus, the surface of the photosensitive drum is uniformly charged with the same polarity as the toner and then radiated with a laser beam, to selectively remove electric charges on the areas stuck by the laser beam. From a difference of potential between the electrostatic latent image formed and the toner on the developing roller, the toner is electrostatically attracted onto the electrostatic latent image and the toner image is formed.

To charge the photosensitive drum, conventionally a charging device for charging by use of high-voltage corona discharge is disposed adjacent to the photosensitive drum.

However, when a high voltage is applied to the charging device, the charging device electrostatically attracts airborne motes around.

In particular, as the charging device is disposed nearby the photosensitive drum, the motes that generate upon the rotation of the photosensitive drum are prone to be attracted to the charging device.

Further, if the charging device is covered with motes in excess, the balance of corona discharge is lost, which generates arc discharge on a part of the charging device. When the arc discharge is generated, the surface of the photosensitive drum is not uniformly charged. Accordingly, as a result of printing, a printout includes a black or white streak on the paper or the entire of the printout becomes black.

SUMMARY OF THE INVENTION

The invention provides an image forming apparatus capable of obtaining good results of image forming by eliminating contamination onto the charging device due to accumulated motes thereon.

As the invention provides a method to reduce or eliminate accumulation of motes on the charging device that charges a photosensitive member, the deterioration of image quality, due to improper charging as may occur in the conventional apparatus, does not occur. In addition, the contamination of the charging device can be prevented effectively, which can increase the operating life of the charging device. In general, a charging wire for the charging device is very thin and careful attention should be paid during cleaning to avoid cutting the wire. However, if the degree of the contamination to the charging device is low, as provided by the invention, the frequency of cleaning of the charging wire is reduced, so that the risk of damage to the charging wire can be reduced.

In an image forming apparatus according to the invention, charging amount control means control a charging amount of the charging device. The charging amount control means controls the charging amount to reduce the charging amount during a standby period from the charging amount used during an image forming period. In other words, when the charging amount from the charging device during the standby is reduced, motes that accumulated on the charging device during the standby can also be reduced. This is advantageous for prevention of improper charging.

To reduce the charging amount during the standby period, a voltage applied to the charging device during the standby period is controlled by chopping. Therefore, there is no need to provide a dedicated circuit for reduction of the charging amount. Further, as the on time and off time for the charging voltage in chopping control are equalized, the structure of the circuit can be simplified.

On the other hand, as an alternative to controlling the voltage to be applied to the charging device during the standby period by chopping, the contamination to the charging device can be prevented or reduced by lowering the charging current of the charging device during the standby period in a similar way.

A fan to generate airflow inside the image forming apparatus and airflow controlling means to control a quantity of the airflow generated by the fan may also be provided. Increasing the quantity of the airflow generated by the fan before the charging device starts charging is also advantageous to prevent or reduce the contamination to the charging device.

When the quantity of the airflow is increased before the charging device starts to charge, it is possible to generate the airflow required to eliminate or reduce airborne motes already existing in the image forming apparatus before charging, by ejecting the motes outside of the image forming apparatus. Thus, such motes, which already exist in the apparatus before charging and which are likely to be attracted to the charging device with the start of charging, are carried on the airflow and ejected outside the apparatus.

In particular, when the quantity of the airflow generated by the fan is controlled so as to increase as print data is received, the effects described above are further increased. Therefore, the charging device is not contaminated due to motes, and charging error does not occur. Thus, the deterioration of the image quality can be prevented or reduced.

Further, the power consumption and the noise of the image forming apparatus can be reduced by reducing the quantity of the airflow from the fan after the charging is completed. At this time, if the quantity of the airflow from the fan is increased for a fixed period of time, motes accumulated near the charging device can be effectively removed. The fan also emits the heat generated in a fixing unit or a control circuit outside the image forming apparatus, to keep the inside of the apparatus cool.

BRIEF DESCRIPTION OF THE DRAWINGS

Various exemplary embodiments of the invention will be described in detail with reference to the following Figs. wherein.

DETAILED DESCRIPTION OF PREFERRED EMBODIMENTS

Various exemplary embodiments of the invention will be described in detail with reference to the accompanying drawings.

(I) Main Structure of Laser Printer

Figure 1:
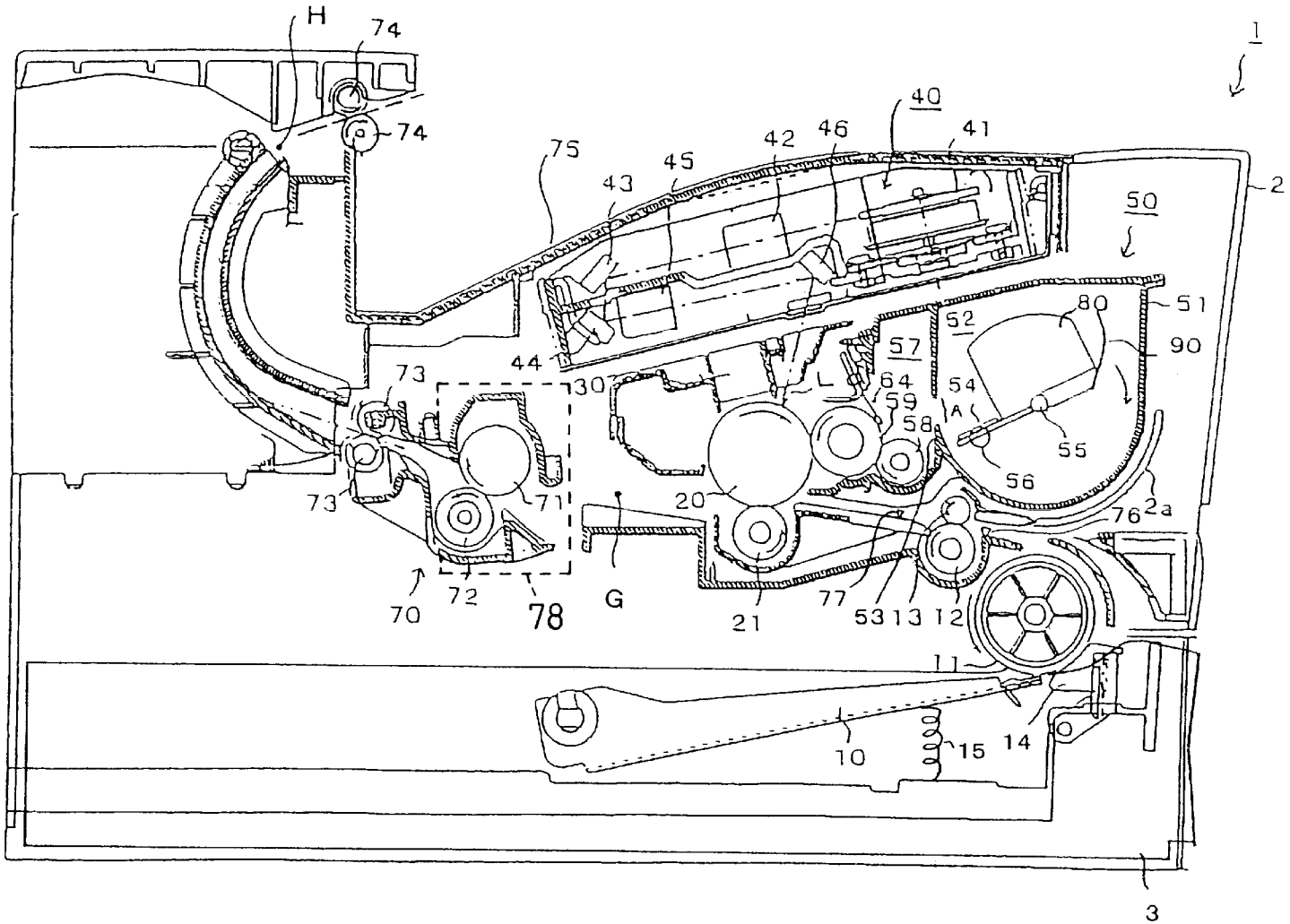
FIG. 1 is a sectional view showing schematic structure of a laser printer.

A laser printer will be described with reference to FIG. 1. FIG. 1 shows a sectional view of the laser printer. As shown in FIG. 1, the laser printer 1 includes a feeder unit 3 that feeds paper, a process cartridge 2*a* having a developing device 50, a scanner unit 40, a fixing unit 70, conveying rollers 73 and paper discharged rollers 74, and a discharge paper tray 75.

The feeder unit 3 is provided at the bottom of a main case 2 that is a housing of the laser printer 1.

The feeder unit 3 is provided with a paper pressing plate 10 pressed by a spring 15, a paper feed roller 11, and a frictional separating member 14. The paper pressing plate 10 presses the paper against the paper feed roller 11. Upon the rotation of the paper feed roller 11, the uppermost sheet of paper placed on the paper pressing plate 10 is separated and fed from between the paper feed roller 11 and the frictional separating member 14 in a predetermined timed sequence.

A pair of resist rollers 12 and 13 are rotatably supported downstream with respect to a paper feed path in which the paper is fed by the paper feed roller 11 that rotates in the direction of an arrow of FIG. 1. The resist rollers 12 and 13 convey the paper to a transfer position formed by a photosensitive drum 20 and a transfer roller 21 in the predetermined timed sequence.

Paper sensors 76 and 77 are disposed in front of and behind the resist rollers 12 and 13 on the paper feed path. The paper sensor 76 detects the front end of a paper to catch a paper feeding timing among a plurality of sheets to be conveyed. The paper sensor 77 detects the rear end of a paper that passes through the resist rollers 12 and 13 to recognize an image forming position on the paper.

The photosensitive drum 20 includes an organic photosensitive member mainly composed of polycarbonate which is to be positively charged. Specifically, the photosensitive drum 20 is formed of a cylindrical aluminum sleeve as a main body and a hollow drum on the outer circumference thereof. On the hollow drum, a light conductive layer with a certain thickness (e.g. approximately 20 $\mu$m thick) is formed from resin-dispersed polycarbonate. The photosensitive drum 20 is rotatably supported on the main case 2 with the cylindrical sleeve being grounded, and rotationally driven by a driving mechanism (not shown) in the direction of the arrow.

A charging device 30 is of the scorotron type and discharges a corona from a charging wire made of tungsten.

The scanner unit 40 includes a laser diode (not shown) that generates a laser beam L for forming an electrostatic latent image on the photosensitive drum 20, a polygon mirror 41 that is rotationally driven, a pair of lenses 42, 45, and reflection mirrors 43, 44, 46.

A toner chamber 52 is formed within a case 51 of the developing device 50. The toner chamber 52 accommodates an agitator 90, a cleaning member 54, and a light-shielding member 80 provided therebetween, which are universally pivotable around a rotating shaft 55.

A toner which is electrically insulative and to be positively charged is held within the toner chamber 52. A light-transmitting window 56 is provided on a side wall on each side of the rotating shaft 55.

Formed on the side of the photosensitive drum 20 is a developing chamber 57 in which a developing process is made through an opening A in the toner chamber 52. In the developing chamber 57, a toner supply roller 58 and a developing roller 59 are rotatably supported. Toner on the developing roller 59 is regulated to a predetermined thickness by a layer thickness-regulating blade 64, which may be a thin, elastic plate, and supplied for the developing process.

The transfer roller 21 is rotatably supported and made from an electrically conductive foamed elastic material such as a silicone rubber and a urethane rubber. When a voltage is applied to the transfer roller 21, a toner image on the photosensitive drum 20 is transferred onto the paper.

The fixing unit 70 is provided further downstream with respect to the paper feed path where the paper is fed and pressed through between the resist rollers 12, 13 and between the photosensitive drum 20 and the transfer roller 21. The fixing unit 70 includes a heat roller 71 and a pressing roller 72. The toner image transferred onto the paper is heated and pressed while it is conveyed between the heat roller 71 and the pressing roller 72, and then the toner image is fixed on the paper.

Provided on a place facing a side of the fixing unit 70 in the main case 2 is a cooling fan 78. The cooling fan 78 is intended to discharge the heat generated by the fixing unit 70 and prevent the temperature of other components around the fixing unit 70 from rising. The cooling fan 78 produces a flow of air from the inside to the outside of the laser printer 1. The flow of air not only lowers the temperature of other components except for the fixing unit 70 but also sucks out impurities such as motes around the charging device 30 and the transfer roller 21 to discharge them outside the laser printer 1, which leads to keep the charging device clean.

The pair of conveying rollers 73 and the pair of paper discharged rollers 74 are provided downstream from the fixing unit 70 in the paper feed path. Provided further downstream from the paper discharged rollers 74 is the discharged paper tray 75 where the paper discharged is stacked.

The photosensitive drum 20, the transfer roller 21, the charging device 30, and the developing device 50 are all accommodated in the process cartridge 2*a*. The process cartridge 2*a* is provided detachably to the laser printer 1.

The developing device 50 is provided as a developing cartridge detachably to the process cartridge 2*a*. The detail of the process cartridge 2*a* is described in U.S. Pat. No. 6,041,203, which is herewith incorporated by reference.

Next, operation of a printing process executed in the laser printer 1, which is arranged in such a manner described above, will be described.

First, the surface of the photosensitive drum 20 is charged uniformly by the charging device 30. The surface of the photosensitive drum 20 is radiated with the laser beam L that is modulated by the scanner unit 40 according to image information. An electrostatic latent image corresponding to the image information is formed on the surface of the photosensitive drum 20. The toner is adhered onto the electrostatic latent image in the developing device 50, making the electrostatic latent image visible. The visible image is conveyed to the transfer position along with the rotation of the photosensitive drum 20.

On the transfer position, the paper is supplied via the paper feed roller 11 and the resist rollers 12, 13. The transfer bias applied by the transfer roller 21 allows the visible image on the surface of the photosensitive drum 20 to be transferred onto the paper.

Toner that remains on the surface of the photosensitive drum 20 after the transfer is collected by the developing roller 59, returned to the developing chamber 57, and reused for the developing.

The paper onto which the visible image has been transferred is conveyed to the fixing unit 70. The paper is sandwiched between the heat roller 71 and the pressing roller 72 to pass through therebetween, and the visible image is fixed onto the paper by the pressure and heat.

The paper onto which the visible image has been fixed is ejected to the paper tray 75 via the conveying rollers 73 and the paper discharged rollers 74 , and this completes the print process operation.

(II) Detailed Structure of Developing Device

Next, the structure of the developing device 50 in the laser printer 1 will be described with reference to FIGS. 2 and 3.

Figure 2:
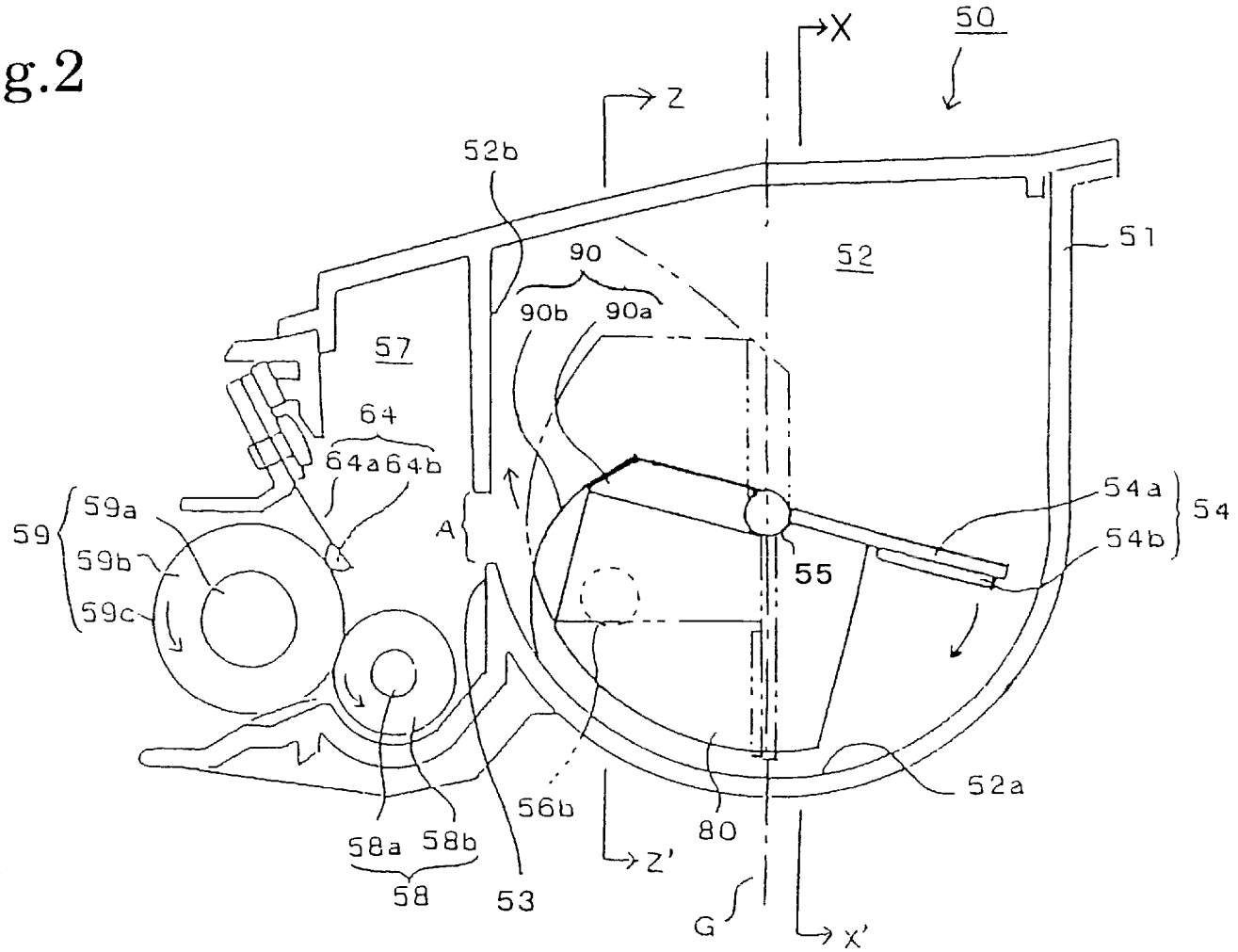
FIG. 2 is a sectional view showing schematic structure of a developing device.
Figure 3:
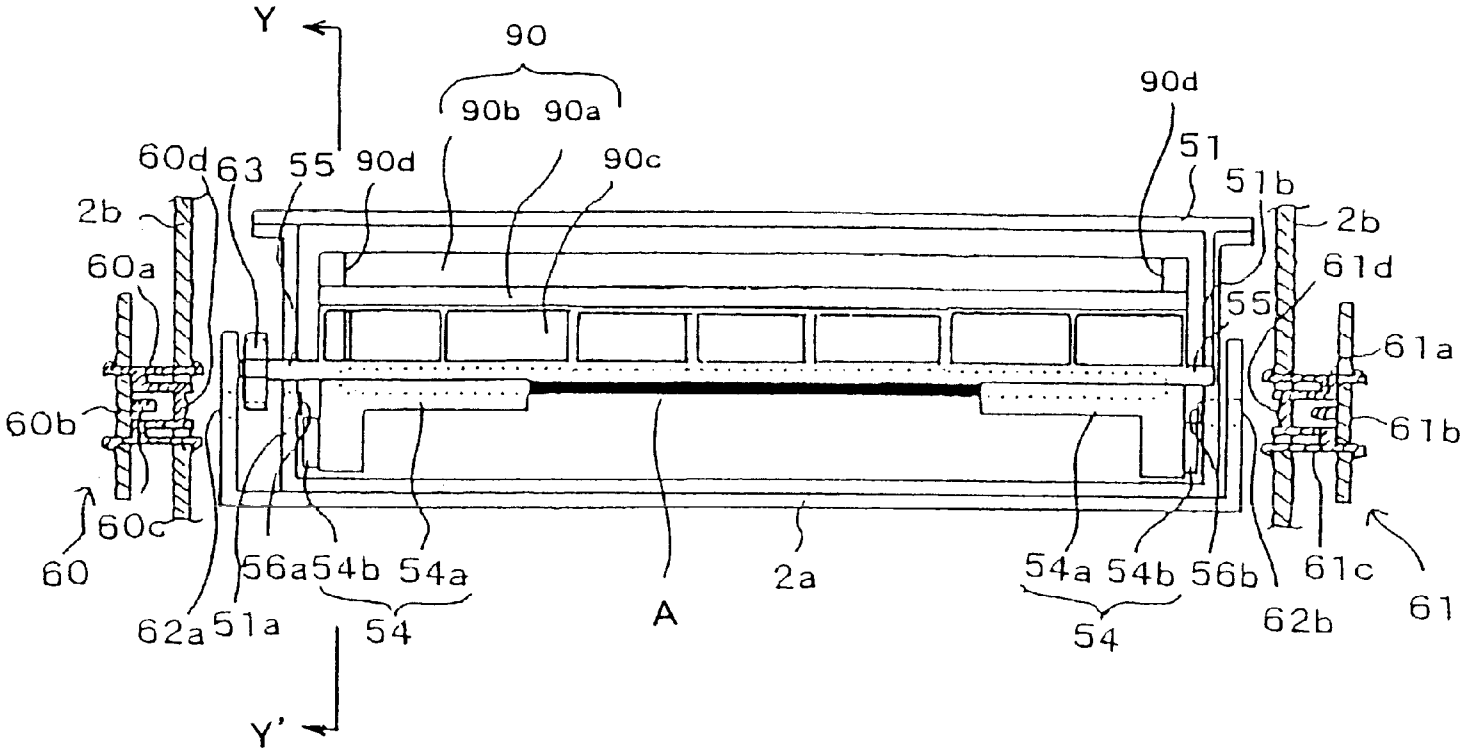
FIG. 3 is a sectional view at line X–X' of FIG. 2.

FIG. 2 shows a sectional view of the developing device 50, taken along the plane of line Y–Y' of FIG. 3. FIG. 3 shows a sectional view of the developing device 50, taken along the plane of line X–X' of FIG. 2.

FIG. 3 shows a cross-sectional view when the agitator 90 and the cleaning member 54 come to a place indicated by a double dashed chain line of FIG. 2. In FIG. 3, a frame 2*b*, a light emitter 60, a light receptor 61, and circuit boards 60*b*, 61*b* are shown in section view. The section correspond to the plane of line Z–Z' of FIG. 2.

The developing device 50 is provided with other constituent elements in a case 51 as shown in FIG. 2, and detachable to the process cartridge 2*a* as shown in FIG. 3. The case 51 forms the toner chamber 52 and the developing chamber 57 and serves as a frame that supports the constituent elements therein.

The constituent elements except for the case 51 will be described.

The developing roller 59 (toner carrier) comprises a metal shaft 59*a* made of stainless steel at its center and a cylindrical base material 59*b* made of a silicone rubber including electrically conductive carbon fine particles, around the metal shaft 59*a*. Further, on the periphery of the cylindrical base material 59*b*, a coating layer 59*c* made of resin or rubber material that includes fluorine is formed.

The base material 59*b* can be made of urethane rubber that is electrically conductive, instead of the electrically conductive silicone rubber.

A predetermined voltage is applied to the developing roller 59 from the power supply (not shown) so that there is a difference in potential between the roller 59 and the photosensitive drum 20.

The layer thickness-regulating blade 64 comprises a support portion 64*a* made of stainless steel and a contact portion 64*b* made of any of an electrically insulative or conductive silicone rubber, a rubber that is electrically insulative or includes conductive fluorine, and an electrically insulative or conductive urethane rubber. The support portion 64*a* is secured at one end to the case 51. The contact portion 64*b* is provided at the tip of the support portion 64*a*. The contact portion 64*b* is pressed into contact with the developing roller 59 elastically by the support portion 64*a*.

The contact portion 64*b* is designed to project from the support member 64*a* having a generally semilunar shape in cross section as shown in FIG. 2, but may be formed to be plate-shaped.

The toner supply roller 58 comprises a metal shaft 58*a* made of stainless steel at its center and a cylindrical base material 58*b* made of a conductive sponge, around the metal shaft 58*a*. The toner supply roller 58 is disposed facing the developing roller 59 so as to press into contact with the developing roller 59 elastically by the sponge.

The conductive silicone rubber, urethane rubber, or other appropriate materials can be used for the toner supply roller 58.

The toner collected in the toner chamber 52 is a non-magnetic one-component developing agent that is to be positively charged. Each particle of the toner has a toner base particle of 6–10 $\mu$m in diameter and 8 $\mu$m on the average. The toner base particle is formed by adding carbon black as a coloring agent, nigrosine, triphenylmethane, quanterary ammonium salt as a charge control agent, to a styrene acrylic resin that is spherically formed by suspension polymerization. Silica, as an additive, is further added to the surface of the toner base particle. The toner is produced in this manner.

Silica is treated to be hydrophobic by a known method using a silane coupling agent. The average particle diameter of silica is 10 $\mu$m and the amount of silica to be added is 0.6%, by weight, of the toner base particle.

The toner has excellent fluidity because it is substantially spherical and suspension-polymerized, and the silica, treated to be hydrophobic, is added to the toner base particle by 0.6%, by weight, of the toner base particle. Accordingly, the toner is sufficiently charged by friction and efficient image transfer and high quality image forming are ensured.

The agitator 90 comprises a support member 90*a* made of an ABS (acrylonitrile, butadiene, styrene) resin and a sliding contact portion 90*b* made of PET (polyethylene terephthalate) forming a plate-shape with a thickness of 75 $\mu$m. The sliding portion 90*b* is attached to the edge of the support member 90*a*.

The support member 90*a* is formed with the rotating shaft 55 supported to side walls 51*a*, 51*b* on both sides of the case 51 as shown in FIG. 3. The rotating shaft 55 has a gear 63 on one end.

The sliding contact portion 90*b* has a width (a turning-radius length) such that the portion 90*b* has flexure and deflection at least when it makes contact with a cylindrical bottom surface 52*a* of the toner chamber 52.

Therefore, when the drive force from the motor (not shown) is transmitted to the gear 63, the agitator 90 having the support member 90*a* and the sliding portion 90*b* rotates in the direction of the arrow indicated in FIG. 2. In the embodiment, the time taken for the agitator 90 to rotate once is approximately 1.3 seconds. Upon the rotation, the sliding portion 90*b* slides into contact to the bottom surface 52*a* of the toner chamber 52 with flexure and deflection, and scrapes the toner into the opening A through the use of a conveying surface.

In FIG. 3, an area filled in with black represents the opening A. Of the opening A, an area hidden by the support member 90*a* is represented with dashed lines.

The sliding contact portion 90*b* has slits 90*d* thereon so as to correspond to both ends of the opening A. A main part for conveying the toner of the sliding contact portion 90*b* which is sandwiched in between the slits 90*d*, elastically goes into the opening A, and flicks the toner to the developing chamber 57.

Not only the sliding contact portion 90*b* but also the support member 90*a* scrapes the toner. The support member 90*a* has an opening 90*c* as shown in FIG. 3. The opening 90*c* serves to reduce a resistance that the surface of the support member 90*a* receives from the toner upon the rotation.

The length of the support member 90*a* and the sliding contact portion 90*b* is set so that it is shorter than that of the case 51. As shown in FIG. 3, the support member 90*a* and the sliding contact portion 90*b* are disposed with a predetermined distance from the light-transmitting windows 56*a*, 56*b* on both sides so as not to make contact with them.

The cleaning member 54 comprises a support member 54*a* that is united with the support member 90*a* of the agitator 90 and wipers 54*b* that are attached to both ends of the support member 54*a*.

Each of the wipers 54*b*, made of urethane rubber, is installed in such a position that it slides into contact with the surfaces of the windows 56*a*, 56*b* to wipe off the toner thereon during the rotation of the support member 54*a*.

The support member 54*a* is installed in such a position that, for example, it becomes parallel to the support member 90*a* of the agitator 90 in the opposite direction with respect to the rotating shaft 55, namely, in such a position that the phase angle between the support member 54*a* and the support member 90*a* becomes 180 degrees.

The light-transmitting window 56 is a transparent or semi-transparent member made of acrylic, polycarbonate, or polypropylene. As shown in FIG. 3, the light-transmitting window 56 comprises one window 56*a* that is installed on the side wall 51*a* on the side of the light emitter 60 of the case 51 and another window 56*b* that is installed on the side wall 51*b* on the side of the light receptor 61.

The windows 56*a*, 56*b* are provided so as to project inside the toner chamber 52 as shown in FIG. 3. The windows 56*a*, 56*b* are designed so that the wipers 54*b* of the cleaning members 54 on both sides can wipe off the surface of the windows 56*a*, 56*b*.

The windows 56*a*, 56*b* are placed in a plane that includes the centerline of the rotation of the agitator 90 and the cleaning member 54, as shown in FIG. 2. The windows 56*a*, 56*b* are provided toward the opening A from the plane G that extends in a vertical direction.

In the process cartridge 2*a*, openings 62*a*, 62*b* are formed facing the windows 56*a*, 56*b*, respectively, as shown in FIG. 3. The opening 62*a* enables the light to be passed in the window 56*a*, and the opening 62*b* enables the light to radiate from the window 56*b*.

On both sides of the developing device 50, the light emitter 60 that emits light for detecting the remaining amount of the toner, and the light receptor 61 that receives the emitted light are provided so as to face the windows 56*a*, 56*b*, respectively, as shown in FIG. 3.

The light emitter 60 includes a holder 60*a* attached to the frame 2*b*, the circuit board 60*b* supported by the holder 60*a*, and a light-emitting device 60*c* provided on the circuit board 60*b*. The holder 60*a*, made of plastic, combines a plastic lens 60*d* on the side facing the window 56*a*.

Similarly, the light receptor 61 includes a holder 61*a* attached to the frame 2*b*, the circuit board 61*b* supported by the holder 61*a*, and a photoreceptor 61*c* provided on the circuit board 61*b*. The holder 61*a*, made of plastic, combines a plastic lens 61*d* on the side facing the window 56*b*. A phototransistor is used for the photoreceptor.

The light-emitting device 60*c*, the plastic lens 60*d*, the opening 62*a*, the windows 56*a*, 56*b*, the opening 62*b*, the plastic lens 61*d*, and the photoreceptor 61*c* are arranged in a substantially straight line, as shown in FIG. 3. The light emitted from the light-emitting device 60*c* is substantially collimated via the plastic lens 60*d*, and passed in the window 56*a* through the opening 62*a*.

Accordingly, when the toner does not exist between the windows 56*a*, 56*b*, the light passed through the window 56*a* is passed through the window 56*b* on the opposite side, the opening 62*b*, and then in the plastic lens 61*d*. The light is gathered via the plastic lens 61*d*, and received at the photoreceptor 61*c*.

Figure 4:
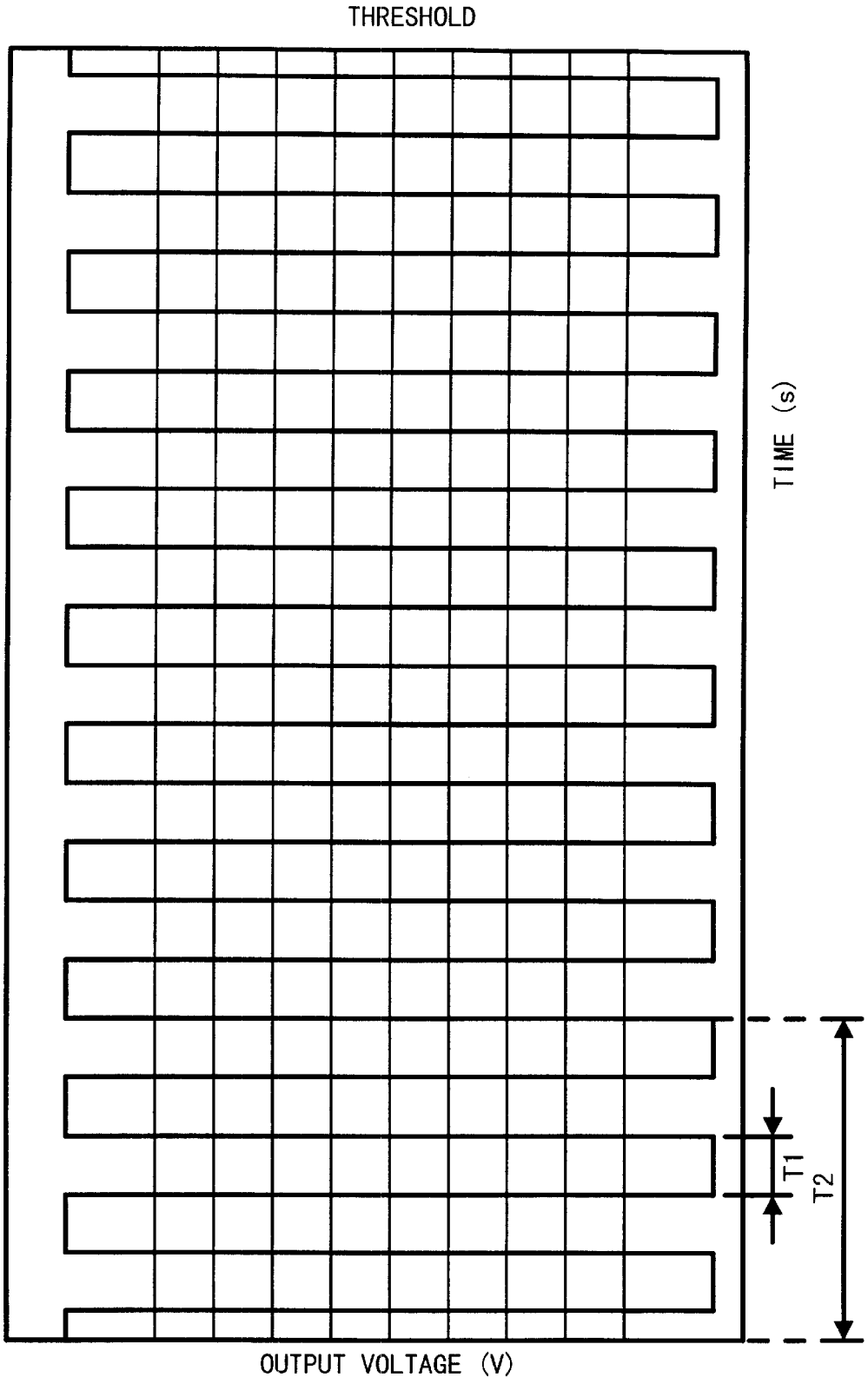
FIG. 4 shows an output voltage waveform of a photoreceptor in the laser printer.

The photoreceptor 61*c* is a device that varies a current value according to the amount of the light received, as shown in FIG. 4. To raise the light-receptive sensitivity relatively, a resistance element with a high resistance (e.g. approximately 470 kilo ohms) is inserted into a power input terminal for the photoreceptor 61*c*. The output voltage becomes close to 5V if the amount of the light at the photoreceptor 61*c* is small, and 0V if the amount is large.

That is, the output voltage varies ranging from 0 to 5V according to the amount of the light received. In the embodiment, the output of the photoreceptor 61*c* is read at a CPU, which will be described later, and a predetermined voltage value is set as a threshold. The output voltage higher than the threshold is determined as a high level, and the output voltage lower than the threshold is determined as a low level. The remaining amount of the toner is detected by calculating the proportion of the total time of time T1, in which the voltage is determined as the low level, to occur within a predetermined measurement period of time T2. If the proportion of time T1 is lower, it means plenty of toner remains. As the remaining amount of the toner is reduced, the proportion of the low level time T1 becomes higher.

A light-shielding member 80 is provided in between the support member 90*a* of the agitator 90 and the support member 54*a* of the cleaning member 54 as shown in FIG. 2. The light-shielding member 80 is formed in a plate shape made of ABS resin, and united with the agitator 90, the cleaning member 54, and the rotating shaft 55. The light-shielding member 80 rotates on the rotating shaft 55. The light-shielding member 80 is provided on the side of the light emitter 60 only with respect to the direction of the length of the rotating shaft 55.

As shown in FIG. 2, the light-shielding member 80 has a shielding surface such that it starts to shield the light to the window 56*b* just after the agitator 90 passes the position of the windows 56*b* and 56*a*, and that it stops shielding the light just before the start of cleaning. Thus, even if the toner around the windows 56*b*, 56*a* is scraped by the agitator 90, the output from the photoreceptor 61*c* can not be obtained as long as the light-shielding member 80 blocks a light path. Resultantly, the right remaining amount of the toner can be detected, unaffected by the environmental conditions or the period of usage. As the light-shielding member 80 is designed to rotate on the rotating shaft 55 which is common to the cleaning member 54 and the agitator 90, its overall structure can be simplified.

(III) Structure and Operation of Controller

The structure of the controller at which the laser printer 1 is electronically controlled will be described with reference to FIG. 5.

Figure 5:
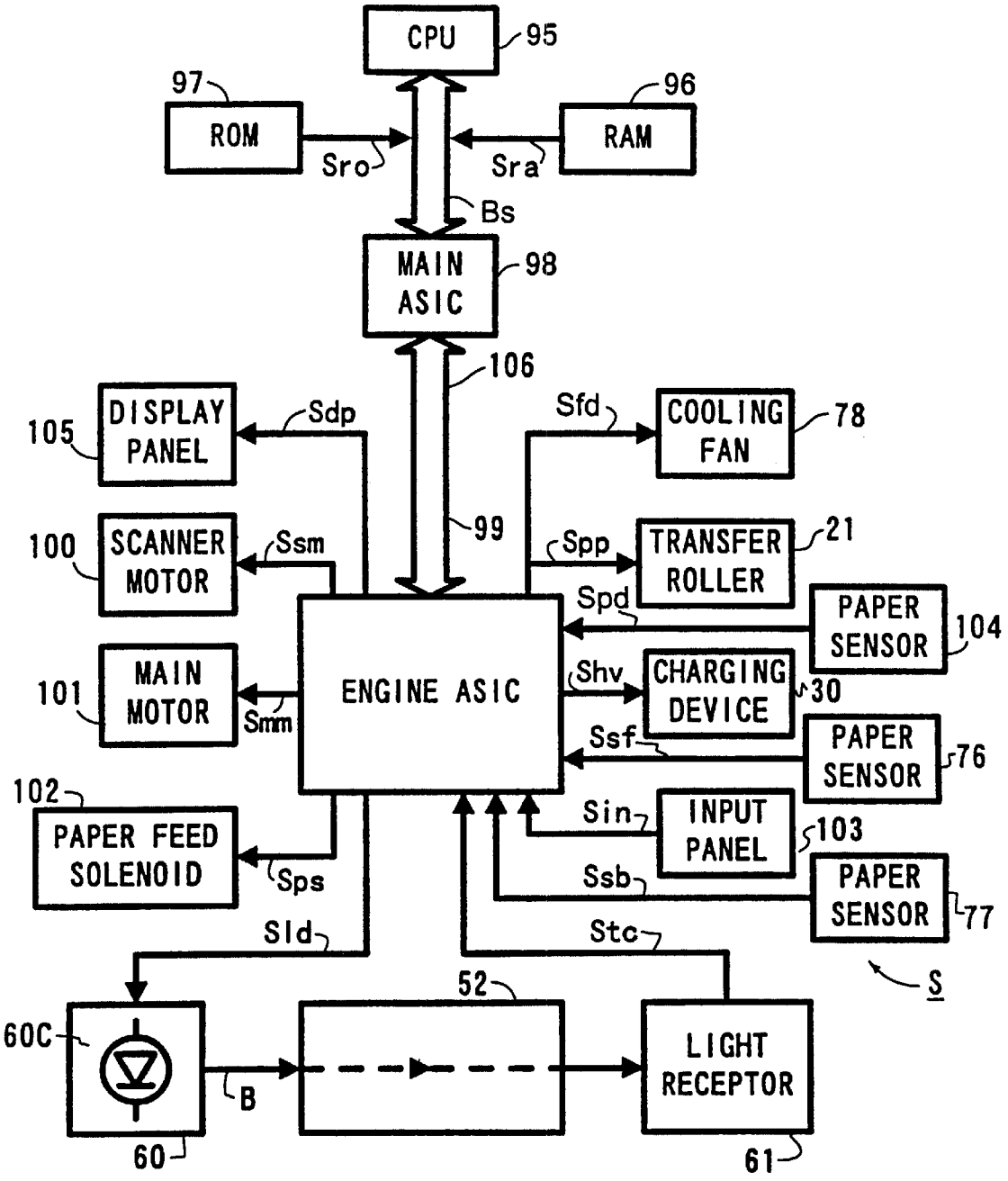
FIG. 5 is a control block diagram of the laser printer.

As shown in FIG. 5, a controller S has a CPU 95, a RAM 96, a ROM 97, a main application specific integrated circuit (ASIC) 98, an engine ASIC 99, a scanner motor 100, a main motor 101, a paper feed solenoid 102, an input panel 103, the transfer roller 21, the charging device 30, paper sensors 76, 77, the cooling fan 78, a paper sensor 104, and a display panel 105.

The CPU 95, the RAM 96, the ROM 97, and the main ASIC 98 are all connected via a bus BS and disposed on a main circuit board, not shown. The engine ASIC 99 is disposed on an engine circuit board, not shown. The main ASIC 98 and the engine ASIC 99 are connected via a serial bus 106 that executes serial communications bidirectionally. The main circuit board and the engine circuit board are accommodated in the space above the paper pressing plate 10.

The operation of the controller will be described in outline.

The scanner motor 100 is used to rotate the polygon mirror 41 in the scanner unit 40, and controlled by control signal Ssm transmitted from the engine ASIC 99.

The main motor 101 is used to rotate the paper feed roller 11, the photosensitive drum 20, the developing roller 59, and the transfer roller 21 while synchronizing each other. The main motor 101 is controlled by control signal Smm transmitted from the engine ASIC 99.

The paper feed solenoid 102 is used when the paper is supplied from the feeder unit 3, and controlled by control signal Sps transmitted from the engine ASIC 99.

The paper sensors 76, 77 detect the front end and rear end of the paper conveyed from the feeder unit 3 respectively, and output control signals Ssf and Ssb that indicate the timings at which the front and rear ends pass through, to the engine ASIC 99.

The paper sensor 104 is provided on the paper feed path. The paper sensor 104 is used to detect that the paper is conveyed to the position of the transfer roller 21 and that the paper is away from the position of the transfer roller 21. The paper sensor 104 outputs paper detection signal Spd indicating the position of the paper to the engine ASIC 99.

The high-voltage application to the charging device 30 is controlled by control signal Shv transmitted from the engine ASIC 99. The detail explanation will be described later.

The number of revolutions of the cooling fan 78 is controlled by control signal Sfd transmitted from the engine ASIC 99. The change of the number of revolutions allows the quantity and velocity of airflow generated in the laser printer 1 to be regulated.

On the input panel 103, operations to specify the motion of laser printer 1 are selected by the user. Input signal Sin corresponding to an operation selected on the panel 103 is produced and output to the engine ASIC 99. The engine ASIC 99 controls the motion of each constituent member of the laser printer 1 based on a description for the input signal Sin.

Necessary information on the operation of the laser printer 1, for example, warning information on the remaining amount of the toner, is output as display signal Sdp from the engine ASIC 99 to the display panel 105. The display panel 105 shows the information thereon.

The light emitter 60 drives the light-emitting device 60*c* based on control signal Sld transmitted from the engine ASIC 99, and emits light B for detecting the toner remaining amount through the window 56*a* and the opening 62*a*, to the inside of the toner chamber 52.

Resultantly, the photoreceptor 61*c* in the light receptor 61 receives the light B which is passed through the toner chamber 52, and produces detection signal Stc that determines the voltage to the low level only during the receiving of the light B passed through the toner chamber 52, and outputs the detection signal Stc to the engine ASIC 99.

The engine ASIC 99 exchanges information with the main ASIC 98 via the serial bus 106 based on the detection signals Ssf, Ssb, Stc, and Spd, and the input signal Sin. Further, the engine ASIC 99 outputs the control signals Ssm, Smm, Sps, and Sfd to drive and control each of the corresponding constituent members, produces the control signal Sld to drive and control the light-emitting device 60*c*, and detects the remaining amount of the toner based on the detection signal Stc.

Simultaneously, the engine ASIC 99 produces control signal Shv so as to control the charging of the charging device 30 based on the detection signals Ssf and Ssb transmitted from the paper sensors 76, 77, and outputs it to the charging device 30. In addition, the engine ASIC 99 produces control signal Spp so as to control the charging state of the transfer roller 21, and outputs it to the transfer roller 21.

The main ASIC 98 exchanges information with the CPU 95 via the bus BS, controls the engine ASIC 99 so as to let it execute control operations described above.

The CPU 95 obtains descriptions of each detection signal via the engine ASIC 99 and the main ASIC 98, and centralizes to control the operations of the entire of the laser printer 1.

Information required for the centralized control is temporarily stored in the RAM 96 as RAM signal Sra, read out and supplied as needed. Furthermore, a program required for the centralized control is prestored in the ROM 97, and read out as ROM signal Sro as needed for the processing at the CPU 95.

(IV) First Mode of Charging Control Process

Figure 6:
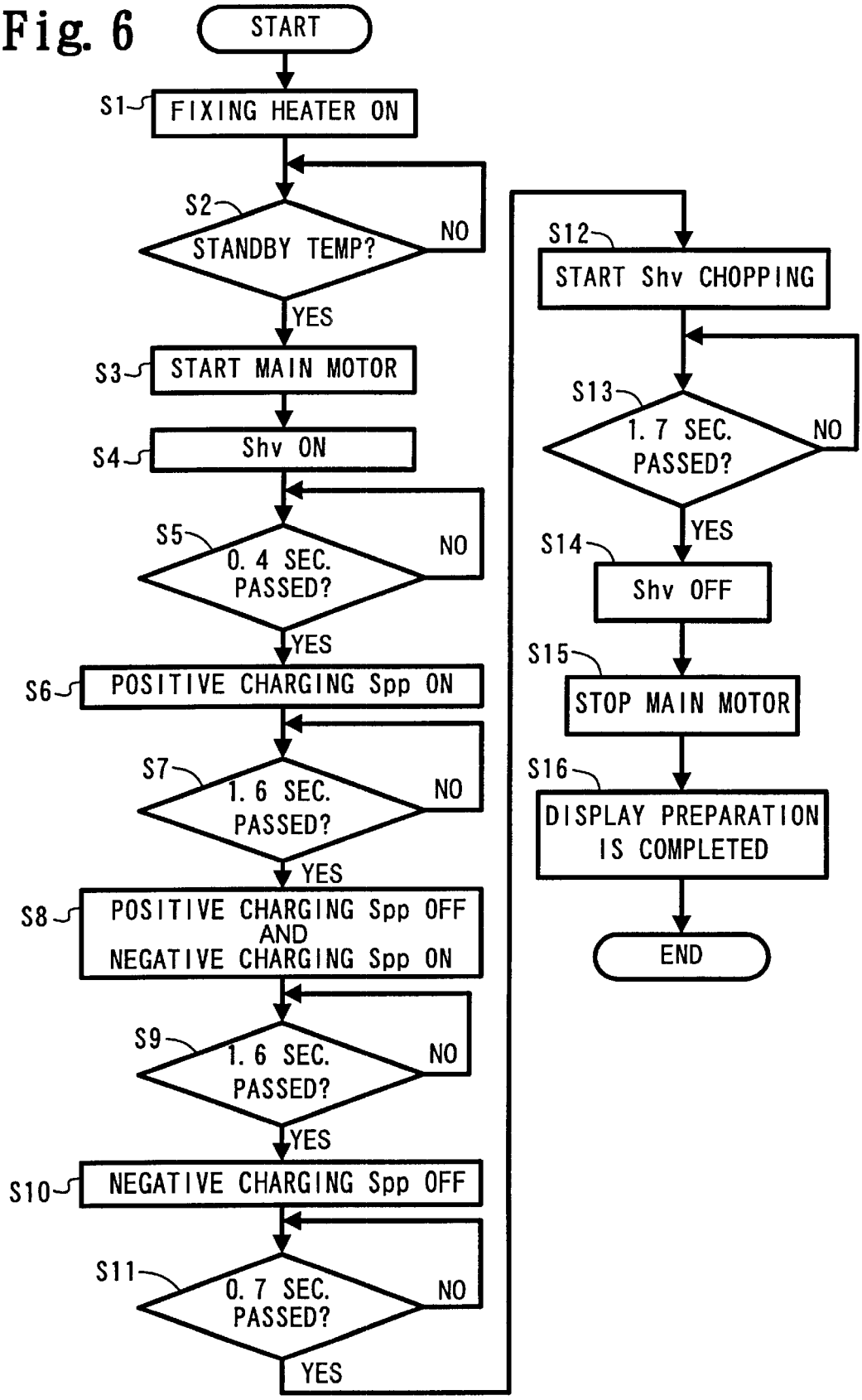
FIG. 6 is a flowchart of a first mode of a charging control process.
Figure 7:
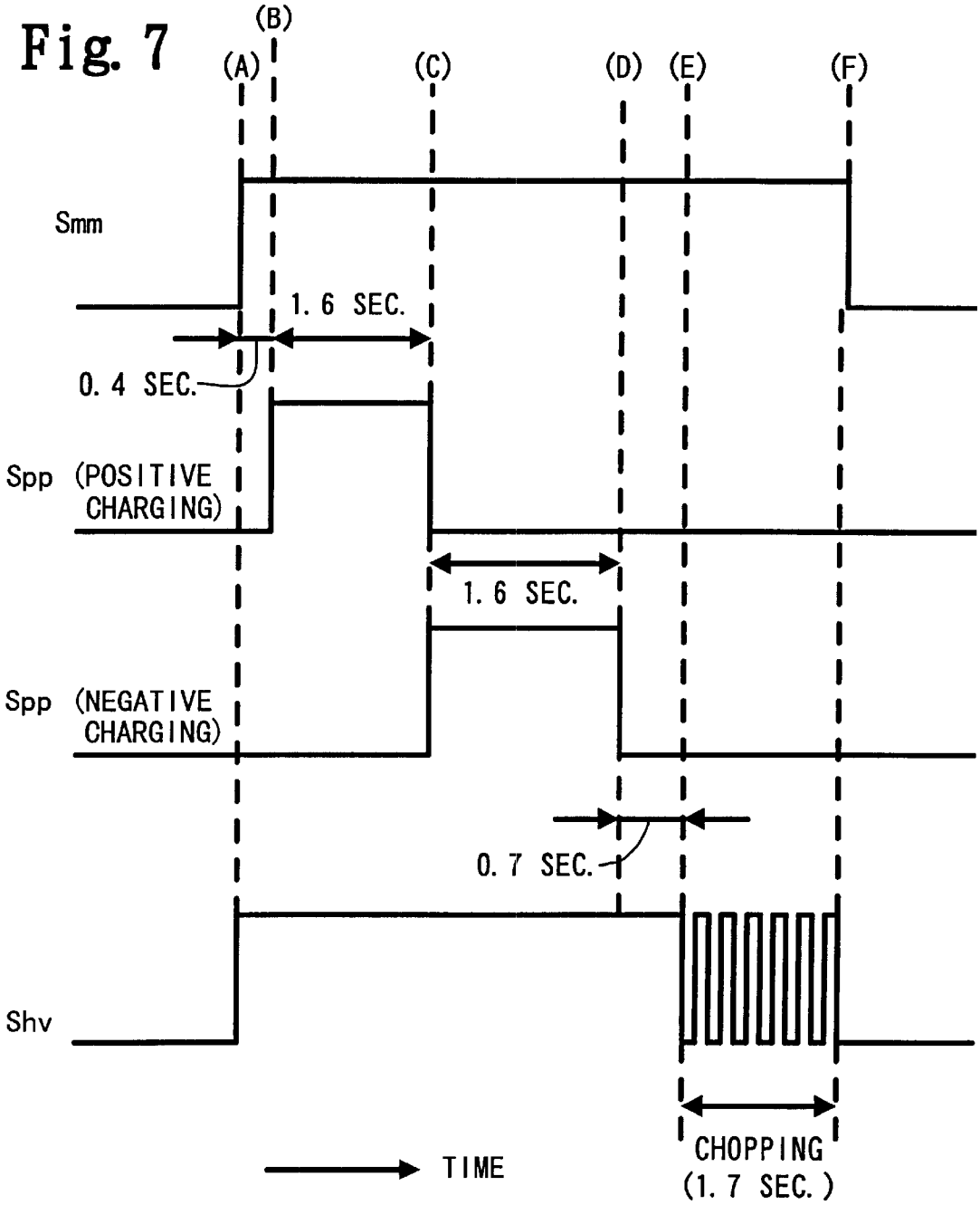
FIG. 7 is a timing chart showing the first mode of the charging control process.
Figure 8:
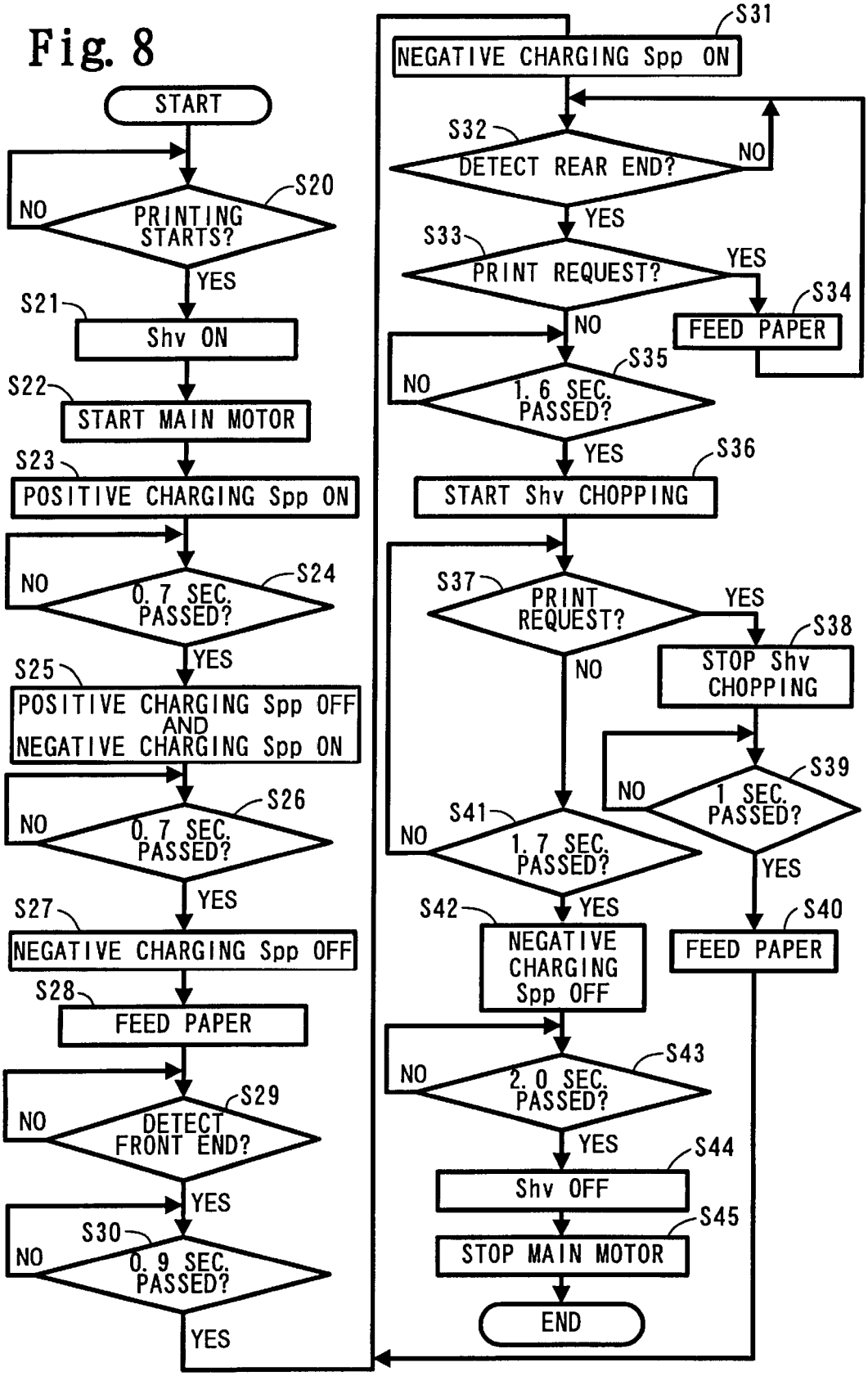
FIG. 8 is a flowchart showing a second mode of the charging control process.

A first mode of a charging control process will now be described with reference to FIGS. 5 to 7.

The first mode refers to the charging control of the charging device 30 during the warm-up executed when the power of the laser printer 1 is turned on.

Specific times used in the first mode are set experimentally based on characteristics of charging with regard to the charging device 30, the transfer roller 21, and the photosensitive drum 20.

In the first mode of the charging control process (during the warm-up), first a heater (not shown) for fixing the toner provided inside the heating roller 71 is turned on (S1). Then, determination is made as to whether the heater has been heated to a predetermined standby temperature (S2).

When the heater is not heated to the standby temperature (S2: N),it is continuously heated until the standby temperature is reached. When it has been heated to the standby temperature (S2: Y), the control signal Smm is output so as to start to rotate the main motor 101 (S3, timing (A) of FIG. 7). Further, the control signal Shv for letting the charging device 30 start to charge is produced and output to the charging device 30, and then a high voltage is applied to the charging device 30 (S4, timing (A) of FIG. 7).

When the main motor 101 is started to rotate, the photosensitive drum 20 and the adjoining developing roller 59 are started to rotate.

While the rotation of the main motor 101 and the application of high voltage to the charging device 30 are performed, determination is made as to whether a timer (not shown) inside the CPU 95 counts 0.4 seconds (S5). If 0.4 seconds have not passed (S5: N), flow is on standby until 0.4 seconds pass. If 0.4 seconds have passed (S5: Y, timing (B) of FIG. 7), to transfer the toner adhered on the transfer roller 21 to the photosensitive drum 20 and return the toner to the photosensitive drum 20, the control signal Spp for charging the transfer roller 21 positively is produced and then output to the transfer roller 21 (S6, timing (B) of FIG. 7).

With the transfer roller 21 being charged positively, whether the timer counts 1.6 seconds is determined (S7). The time of 1.6 seconds is slightly longer than that taken for two rotations of the transfer roller 21. That is, it is assumed that, while the photosensitive drum 20 turns twice, the toner adhered on the transfer roller 21 can be returned to the photosensitive drum 20. If 1.6 seconds have not passed (S7: N) , flow is on standby until 1.6 seconds pass. If 1.6 seconds have passed (S7: Y, timing (C) of FIG. 7), to transfer a small amount of toner which is adhered on the transfer roller 21 and to be negatively charged to the photosensitive drum 20 and return the toner to the photosensitive drum 20, the control signal Spp for charging the transfer roller 21 negatively is produced and then output to the transfer roller 21 (S8, timing (C) of FIG. 7).

Probable causes of toner adhesion onto the transfer roller 21 are defective condition after a paper jam, incorrect printing due to setting of wrong paper size, and other types of trouble.

With the transfer roller 21 being charged negatively, whether the timer counts 1.6 seconds is determined (S9). When 1.6 seconds have not passed (S9: N), flow is on standby until 1.6 seconds pass. When 1.6 seconds have passed (S9: Y, timing (D) of FIG. 7), the control signal Spp is set to off, to stop charging the transfer roller 21 (S10). Further, whether the timer counts 0.7 seconds (the time taken for a half turn of the photosensitive drum 20) is determined (S11). If 0.7 seconds have not passed (S11: N), flow is on standby until 0.7 seconds pass. When 0.7 seconds have passed (S11: Y, timing (E) of FIG. 7), the control signal Shv is produced so as to chop the high-voltage application to the charging device 30, and then output to the charging device 30 (S12, timing (E) of FIG. 7).

A state of chopping will now be described. In chopping, charging on time and charging off time are set to 20 msec equally. In other words, the control signal Shv is output so as to repeat 20 msec of the charging on time and 20 msec of the charging off time in a period of 40 msec.

The reason the charging on and off times are set to 20 msec will be described. In the laser printer 1, a peripheral velocity of the photosensitive drum 20 is 70 msec, and the width of the charging device 30 in the rotational direction of the photosensitive drum 20 is 14 mm. If the charging on time and the charging off time are set to 200 msec or more, the surface of the photosensitive drum 20 is not uniformly charged. When the photosensitive drum 20 is shifted from the charging on state to the charging off state, the charging amount on the photosensitive drum 20 is reduced in terms of exponential function. As approximately 10 msec is required to stabilize the reduction, time should be set shorter than 200 msec and longer than 10 msec. Therefore, the charging on time and the charging off time are each set to 20 msec.

When the chopping control of the charging device 30 is started, determination is made as to whether the timer counts 1.7 seconds (S13). If 1.7 seconds have not passed (S13: N), flow is on standby until 1.7 seconds pass. If 1.7 seconds have passed (S13: Y, timing (F) of FIG. 7), to finish the warm-up of a total of 6 seconds, the control signal Shv is output to set the charging of the charging device 30 to off (S14). Further, the control signal Smm is output so as to stop the rotation of the main motor 101 (S15). The display panel 105 shows that printing preparation is completed (S16), and the charging control process in the warm-up is finished.

(V) Second Mode of Charging Control Process

A second mode of the charging control process will now be described.

The second mode refers to the charging control of the charging device 30 after the printing is started at the laser printer 1.

As in the case of the first mode, specific times used in the second mode are set experimentally based on characteristics of charging with regard to the charging device 30, the transfer roller 21, and the photosensitive drum 20.

In the second mode of the charging control process (during printing), determination is made as to whether a command signal indicating the start of printing has been transmitted from an external information processing apparatus (not shown) that is connected to the laser printer 1 (S20).

If the command signal is not transmitted (S20: N), flow is on standby until the signal is transmitted. In other words, the state of which the process at S16 in FIG. 6 is completed is maintained in this case. When the command signal is transmitted (S20: Y), the control signal Shv is produced so as to let the charging device 30 start to charge, and output to the charging device 30 (S21, timing (A) of FIG. 9). Further, the control signal Smm is produced so as to order the main motor 101 to start to rotate, and output to the main motor 101 (S22, timing (A) of FIG. 7). As with S6, to transfer the toner adhered on the transfer roller 21 to the photosensitive drum 20 and return the toner to the photosensitive drum 20, the control signal Spp for charging the transfer roller 21 positively is produced and then output to the transfer roller 21 (S23, timing (A) of FIG. 9).

Then, the charging device 30 starts to charge, the main motor 101 starts to rotate, and the transfer roller 21 is started to be charged positively. With these situations, whether the timer counts 0.7 seconds (corresponding to the time taken for one turn of the transfer roller 21) is determined (S24). If 0.7 seconds have not passed (S24: N), flow is on standby until 0.7 seconds pass. If 0.7 seconds have passed (S24: Y, timing (B) of FIG. 9), as with S8, to transfer a very small amount of toner, which is adhered on the transfer roller 21 and negatively to be charged, to the photosensitive drum 20 and return the toner to the photosensitive drum 20, the control signal Spp for charging the transfer roller 21 negatively is produced and then output to the transfer roller 21 (S25, timing (B) of FIG. 9).

With the transfer roller 21 being charged negatively, determination is made as to whether the timer counts 0.7 seconds (S26). If 0.7 seconds have not passed (S26: N), flow is on standby until 0.7 seconds pass. If 0.7 seconds have passed (S26: Y, timing (C) of FIG. 9), it is assumed that the cleaning of the transfer roller 21 just before printing is completed, the charging to the transfer roller 21 is suspended (S27, timing (C) of FIG. 9), and paper feeding is started (S28).

Determination is made as to whether the paper sensor 76 detects a front end of the paper (S29). If the paper sensor 76 does not detect the front end of the paper (S29: N), flow is on standby until the front end of the paper is detected. If the paper sensor 76 detects the front end of the paper (S29: Y, timing (D) of FIG. 9), whether the timer counts 0.9 seconds is determined (S30). Time of 0.9 seconds is a predetermined time required from the time when the front end of the paper is detected to the time when the paper is conveyed to the position of the transfer roller 21. If 0.9 seconds have not passed (S30: N), the paper is continuously conveyed and flow is on standby until 0.9 seconds pass. When 0.9 seconds have passed (S30: Y, timing (E) of FIG. 9), to start printing on the paper conveyed, the control signal Spp is output so as to charge the transfer roller 21 negatively (S31, timing (E) of FIG. 9), and the printing is started.

Figure 9:
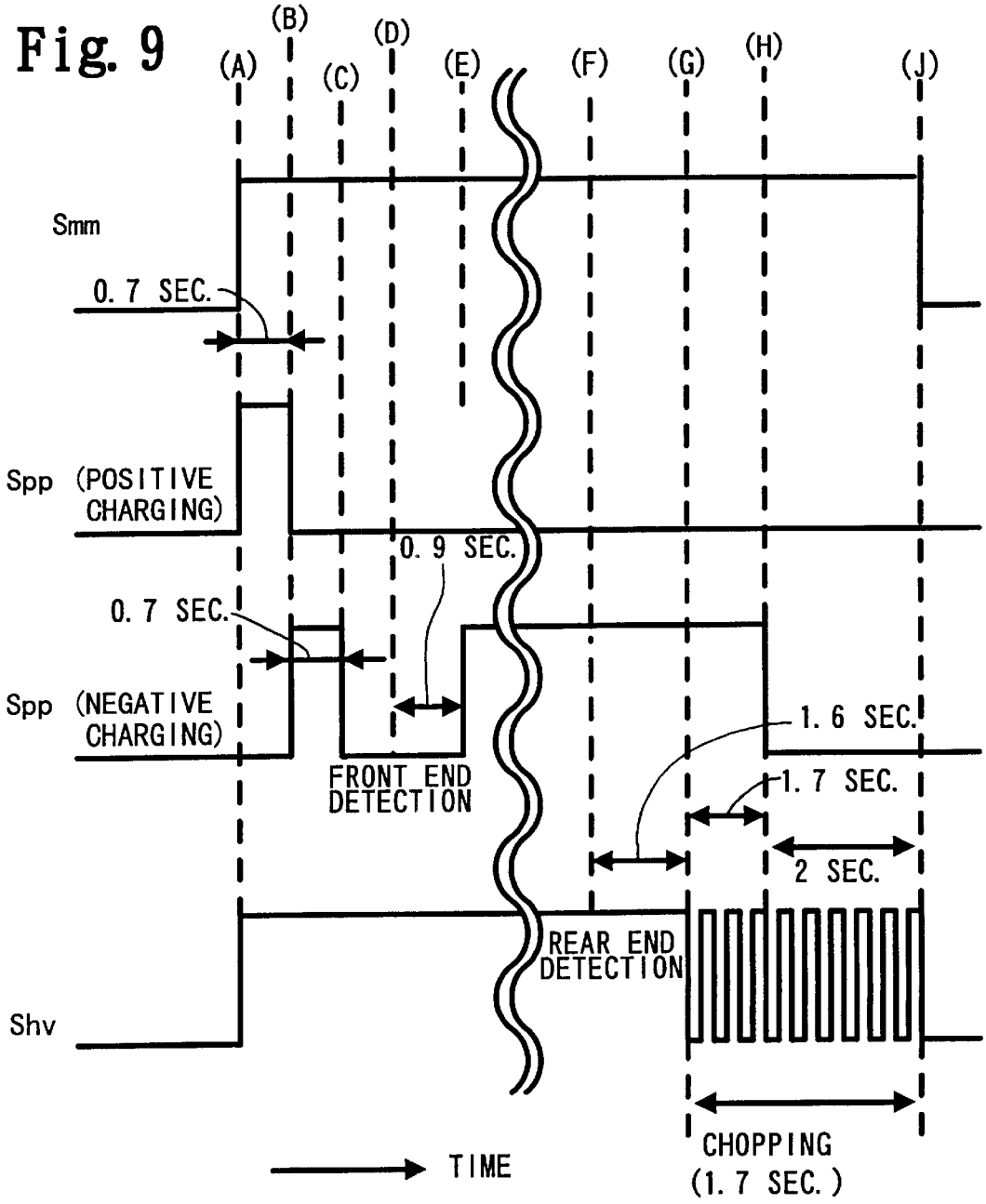
FIG. 9 is a timing chart showing the second mode of the charging control process.

To print a plurality of sheets successively, each signal is supposed to maintain the state at the time when the process at S31 is completed, as shown in FIG. 9.

While the printing continues, whether the paper sensor 77 detects a rear end of the paper is determined (S32). If the paper sensor 77 does not detect the rear end of the paper (S32: N), it is determined that the printing process is ongoing and the paper is being conveyed, and the printing is continued. If the sensor 77 detects the rear end of the paper (S32: Y, timing (F) of FIG. 9), whether the sequential printing request is sent from the external information processing device is determined (S33).

If there is a printing request (S33: Y), paper feeding is continued (S34), and flow returns to S32 to continue printing for the printing request.

When there is no sequential printing request at S33, in other words, when the printing for all information that has to be printed is completed (S33: N), determination is made as to whether the timer counts 1.6 seconds since the printing request does not come (S35). Time of 1.6 seconds is a time required for the rear end of the paper passed through the transfer roller 21 to reach between the transfer roller 21 and the fixing unit 70 (reference character G in FIG. 1). When 1.6 seconds have not passed (S35: N), the paper ejection is continued until 1.6 seconds pass. When 1.6 seconds have passed (S35: Y, timing (G) of FIG. 9), the control signal Shv is produced so as to chop the high-voltage application to the charging device 30, and then output to the charging device 30 (S36, timing (G) of FIG. 9).

In chopping, the charging on time and the chopping off time are set to 20 msec for the same reason as in the first mode. Accordingly, the control signal Shv is output so as to repeat 20 msec of the charging on time and 20 msec of the charging off time in the period of 40 msec.

After the chopping control to the charging device 30 is started, whether a new printing request is sent from the information processing device is determined (S37).

When there is a printing request (S37:Y), the chopping control to the charging device 30 is stopped (S38). After the stop of the chopping, determination is made as to whether the timer counts 1 second (S39). Time of 1 second is a predetermined time required until the charging device 30, which is controlled by chopping, resumes a stable corona discharge. When 1 second has not passed (S39: N), the high-voltage is continuously applied to the charging device 30 until 1 second passes. When 1 second has passed (S39: Y), it is assumed that corona discharge at the charging device 30 has been already stable, paper feeding is resumed (S40). Then flow returns to S32 to continue printing corresponding to the printing request (S37).

When there is no printing request (S37: N), whether the timer counts 1.7 seconds is determined (S41). Time of 1.7 seconds is a time required for the rear end of the paper to reach upstream from the paper discharged rollers 74 (reference character H in FIG. 1). When 1.7 seconds have not passed (S41: N), flow returns to S37 to receive the sequential printing request. When 1.7 seconds have passed (S41: Y), charging to the transfer roller 21 is caused to stop (S42, timing (H) of FIG. 9), and determination is made as to whether the timer counts 2.0 seconds (S43). When 2.0 seconds have not passed (S43: N), flow is on standby until 2.0 seconds pass. When 2.0 seconds have passed (S43: Y, timing (J) of FIG. 9), the control signal Shv is output (S44) to set the charging of the charging device 30 to off, and the control signal Smm is output to stop the main motor 101 (S45), and the printing process is completed.

According to the charging control process in the above-mentioned modes, as the continuity to the charging device 30 is controlled by chopping during the period in which no image is formed, the charging amount at this time is reduced more than that during the time in which an image is formed. Therefore, while no image is formed, adherence of the toner or other objects to the charging device 30 can be prevented.

With the situation that the charging amount is decreased by controlling the charging of the charging device 30 by chopping, for one second just before the next printing is resumed, the continuity to the charging device 30 is controlled so that it can be equalized to that in the normal image forming. Therefore, stable corona discharge from the charging device 30 can be obtained at the start of the printing. That is, the printing can be resumed under the condition that the surface of the photosensitive drum 20 is uniformly charged.

As the chopping control can reduce the charging amount of the charging device 30, there is no need to provide a new circuit only for reducing the charging amount. As the charging on time and off time are set to 20 msec in the chopping control, the charging amount can be reduced.

The charging on time and off time are determined based on the time found by dividing the width of the charging device 30 with respect to the rotational direction of the photosensitive drum 20 by its peripheral velocity. Thus, the chopping control is made so that the charging on time and off time occur successively. This enables the charging to the surface of the photosensitive drum 20 uniformly.

In each mode described above, the charging amount is reduced by controlling the charging of the charging device 30 by chopping. However, it can be reduced by reducing the current of the charging device 30. In this case, the charging amount can be reduced with a simple structure.

(VI) Cooling Fan Control Process

Next, a cooling fan control process will be described with reference to FIGS. 10 and 11.

Figure 10A:
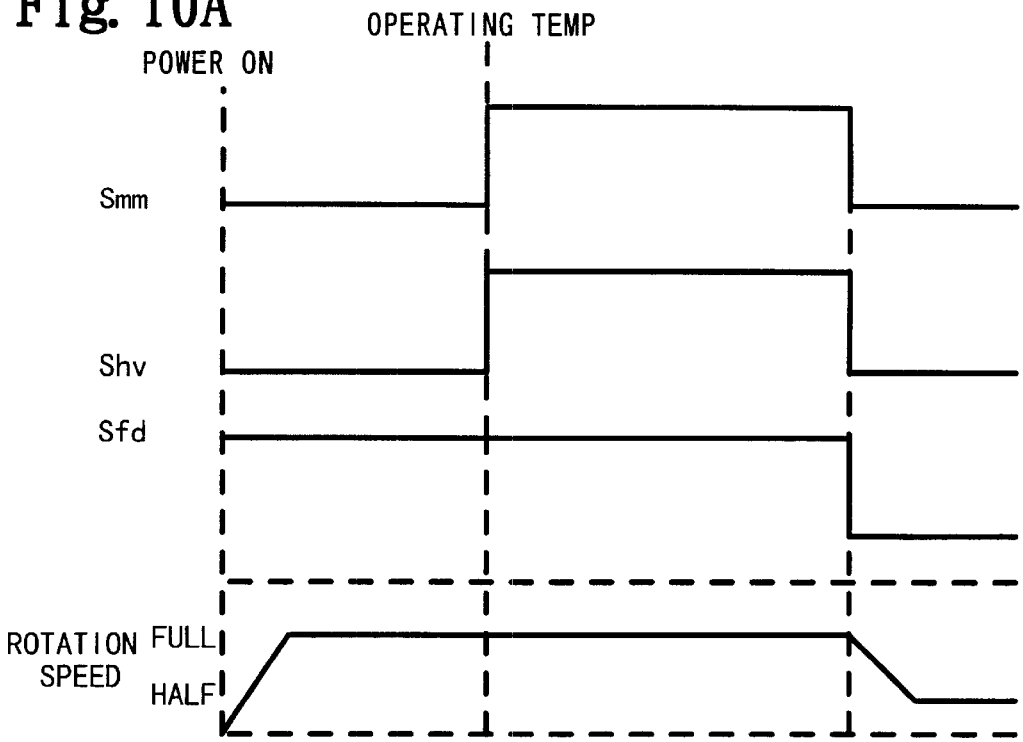
FIG. 10A is a timing chart showing a first cooling fan control process.
Figure 10B:
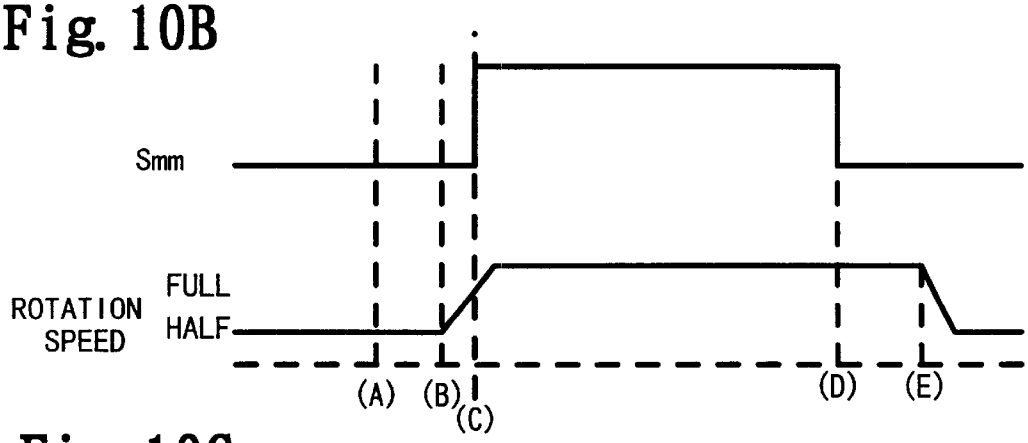
FIG. 10B is a timing chart showing a second cooling fan control process.
Figure 10C:
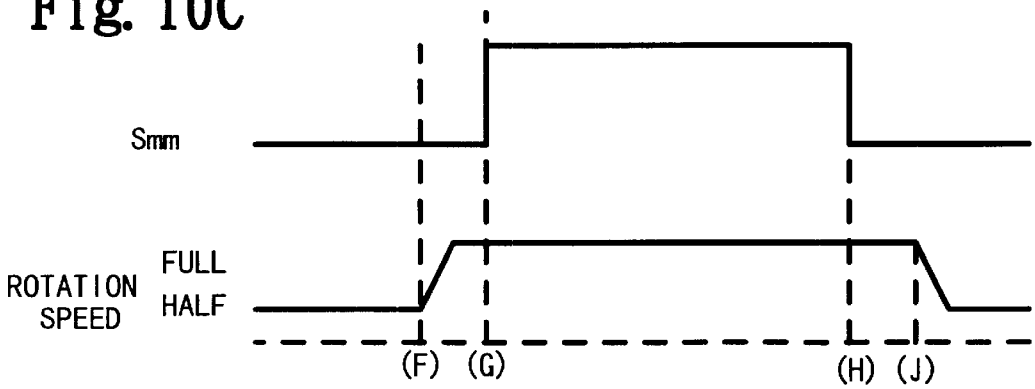
FIG. 10C is a timing chart showing a third cooling fan control process.

In the cooling fan control process, three kinds of processes shown in FIGS. 10A, 10B, and 10C are performed in an appropriate timed relationship with the motion of the laser printer 1.

A first cooling fan control process will be described. In the warm-up just after the power of the laser printer 1 is turned on, as shown in FIG. 10A, the control signal Sfd used for controlling the operation of the cooling fan 78 is set to the level at which the cooling fan 78 turns at full speed.

Thus, the cooling fan 78 starts to turn at the same time when the power is turned on, and turns at full speed after increasing the speed, for example, after 1.5 seconds.

Under this condition, the cooling fan 78 keeps full speed to generate the airflow inside the laser printer 1. In addition, the cooling fan 78 still keeps full speed even when the heater inside the heat roller 71 reaches the operating temperature, the charging device 30 starts to operate, and the main motor 101 starts. The cooling fan 78 continues to turn at full speed until the main motor 101 stops after the predetermined warm-up and corona discharge from the charging device 30 stops.

After the warm-up has completed, the control signal Sfd is changed to the level at which the cooling fan 78 turns at half speed. The speed of the cooling fan 78 is gradually reduced along with the level change. On and after the timing at which the speed is reduced to the half speed, the cooling fan 78 maintains half speed and shifts to the standby state.

Next, a second cooling fan control process will be described as shown in FIG. 10B. Image information to be printed is input from a host computer to the laser printer 1 in timing (A) of FIG. 10B. When a print start command is issued in timing (B) of FIG. 10B, the control signal Sfd is set to the level at which the cooling fan 78 turns at full speed before the main motor 101 turns and the charging of the charging device 30 starts.

This allows the cooling fan 78 to increase the speed from the half to the full simultaneously when the print start command is input, that is, in timing (B), starting to turn the cooling fan 78 at full speed after 1.5 seconds.

The rotation of the main motor 101 and the charging of the charging device 30, which correspond to the print start command input, are started after the speed of the cooling device 30 is increased, for example, after one second have passed from the timing (B), that is, in timing (C) of FIG. 10B.

After the printing operation is completed, the rotation of the main motor 101 and the charging of the charging device 30 are caused to stop in timing (D) of FIG. 10B. Then, the cooling fan 78 continues to turn at full speed for 5 seconds, and then the control signal Sfd is set to the level at which the cooling device 30 turns at half speed in timing (E) of FIG. 10B. Along with the level change, the speed of the cooling fan 78 is gradually reduced. After it is reduced to half speed, the cooling fan 78 maintains half speed and shifts to the standby state.

Finally, a third cooling fan control process will be described. When image information to be printed is input from the host computer to the laser printer 1 in timing (F) of FIG. 10C, the control signal Sfd is set to the level at which the cooling fan 78 turns at full speed before the main motor 101 starts to rotate and the charging of the charging device 30 starts.

The cooling fan 78 increases its speed from half speed as soon as the image information is input, and starts to turn at full speed after 1.5 seconds from the timing (F).

When a print start command is issued from the host computer in timing (G) of FIG. 10C, the main motor 101 starts to rotate and the charging of the charging device 30 starts.

After the printing operation is completed, the rotation of the main motor 101 and the charging of the charging device 30 are caused to stop in timing (H) of FIG. 10C, and then the cooling fan 78 continues to turn at full speed for 5 seconds. After that, in timing (J) of FIG. 10C, the control signal Sfd is set to the level at which the cooling fan 78 turns at half speed. Along with the level change, the speed of the cooling fan 78 is gradually reduced. After it is reduced to half speed, the cooling fan 78 maintains half speed and shifts to the standby state.

A flow of the cooling fan control process including three kinds of control processes described in FIGS. 10A, 10B, 10C will now be described with reference to FIG. 11.

Figure 11:
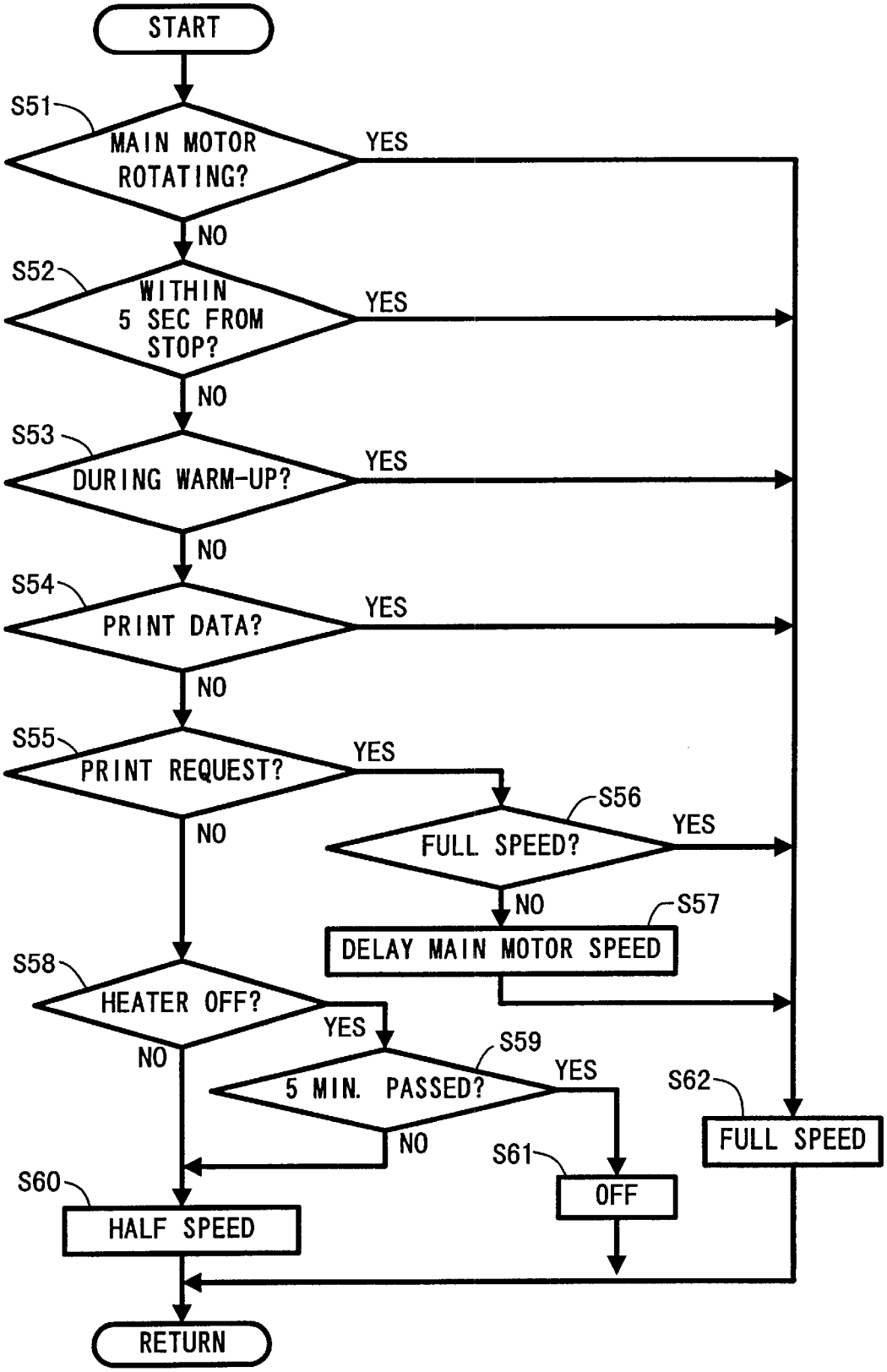
FIG. 11 is a flowchart showing the cooling fan control process.

A program corresponding to the flowchart shown in FIG. 11 is prestored in the ROM 97. The program is read as a ROM signal Sro into the CPU 95, causing the cooling fan control process to be executed in the main ASIC 98 and the engine ASIC 99 that are operated by or under the CPU 95.

The cooling fan control process shown in FIG. 11 is executed continuously with other processes executed by the laser printer 1, such as paper jam detection process, toner remaining amount detection process, cover open detection process, printing process, and toner fixing process. The cooling fan control process is executed among the above processes every 5 msec on a regular basis.

As shown in FIG. 11, in the cooling fan control process, determination is made as to whether the main motor 101 is rotating based on the level of the control signal Smm, in other words, whether the charging device 30 is driving (S51). When the main motor 101 is rotating (S51: Y), the control signal Sfd is set to the level at which the cooling fan 76 turns at full speed (S62), and the velocity and the quantity of the airflow generated by the cooling fan 78 are maximized. Then, every kind of process of the laser printer 1 is executed and the process shown in FIG. 11 is repeated again.

Thus, while the main motor 101 is rotating, the cooling fan 78 is always supposed to turn at full speed.

On the other hand, when the main motor 101 is not rotating (S51: N), determination is made as to whether the current time is in the timing at which the timer (not shown) counts 5 seconds since the stop of the rotation of the main motor 101 and the charging of the charging device 30 (S52). When the current time is within 5 seconds (S52: Y), flow goes to S62 to continue to turn the cooling fan 78 at full speed and maximize the velocity and the quantity of the airflow generated by the cooling fan 78. Then, every kind of process of the laser printer 1 is executed and the process shown in FIG. 11 is repeated again.

That is, the cooling fan 78 continues to turn at full speed for 5 seconds after the printing is stopped, as described in FIGS. 10B and 10C.

When it is determined that 5 or more seconds have passed after the main motor 101 is stopped (S52: N), determination is made as to whether the warm-up is ongoing (S53). When the warm-up is ongoing (S53:Y), flow goes to S62 to continue to turn the cooling fan 78 at full speed and maximize the velocity and the quantity of airflow generated by the cooling fan 78. Then, every kind of process of the laser printer 1 is executed, and the process shown in FIG. 11 is repeated again. In other words, the cooling fan 78 is always kept at full speed during the warm-up as described in FIG. 10A.

When the warm-up is not ongoing (S53: N), determination is made as to whether print data is input from the host computer (S54). When the print data is input (S54: Y), flow goes to S62 to turn the cooling fan at full speed and maximize the velocity and the quantity of airflow generated by the cooling fan 78. Then, every kind of process of the laser printer 1 is executed, and the process shown in FIG. 11 is repeated again. In other words, the cooling fan 78 starts to turn at full speed since the timing at which the print data is input, as described in FIG. 10C.

When the print data is not input (S54: N), determination is made as to whether the print start command is input from the host computer (S55). When the print start command is input from the host computer (S55: Y), determination is made as to whether the cooling fan 78 is already turning at full speed (S56). When the cooling fan 78 is turning at full speed (S56: Y), flow goes to S62 to continue to rotate the cooling fan 78 at full speed, and maximize the velocity and the quantity of airflow generated by the cooling fan 78. Then, every kind of process of the laser printer is executed, and the process shown in FIG. 11 is repeated again.

When the cooling fan 78 is not turning at full speed (S56: N), the start of the main motor 101 and the charging of the charging device 30 is delayed for one second, so as to wait until the speed of the cooling fan 78 increases (S57). After one second, the rotation of the main motor 101 and the charging of the charging device 30 are started. Then, flow goes to S62 to turn the cooling fan 78 at full speed and maximize the velocity and the quantity of airflow generated by the cooling fan 78. Then, every kind of process of the laser printer 1 is executed, and the process shown in FIG. 11 is repeated again. In other words, the printing operation is started after one second since the cooling fan 78 starts to turn at full speed, as described in FIG. 10B.

When the print start command is not input (S55: N), determination is made as to whether the heater in the heat roller 71 is turned off (S58). When the heater is turned off (S58: Y), determination is made as to whether five minutes have passed after the heater is turned off, in other words, whether the heat roller 71 including the heater and the pressing roller 72 are allowed to cool sufficiently (S59).

When five minutes have passed (S59: Y), the heat roller 71 and the pressing roller 72 are supposed to be allowed to cool sufficiently, and the control signal Sfd to cause the cooling fan 78 to stop is output (S61). Then, every kind of process of the laser printer 1 is executed and the process shown in FIG. 11 is repeated again.

When five minutes have not passed (S59: N), the heat roller 71 is supposed not to cool sufficiently. To allow the heat roller 71 to cool, the control signal Sfd is set to the level at which the cooling fan 78 turns at half speed (S60), and the cooling fan 78 is kept at half speed. Then, every kind of process of the laser printer 1 is executed and the process shown in FIG. 11 is repeated again.

When the heater is not turned off (S58: N), flow goes to S60 to allow the heater 71 to cool and then shift it to the standby state. The control signal Sfd is set to the level at which the cooling fan 78 turns at half speed, and the cooling fan 78 is kept at half speed.

According to the cooling fan control process described above, the quantity and the velocity of airflow generated by the cooling fan 78 are increased since the warm-up. Therefore, motes likely to be adhered to the charging device 30 can be effectively eliminated by use of the airflow.

As the quantity and the velocity of the airflow generated by the cooling fan 78 are increased before the printing operation is started, image forming can be effectively started after the airflow removes motes from the charging device 30. In other words, the airflow is generated inside the laser printer 1 before the charging device 30 starts to charge, improving the environment of the laser printer 1 so that motes and other objects are ejected outside. Therefore, motes likely to be adhered to the charging device 30 can be eliminated by use of the airflow.

As the quantity and the velocity of the airflow generated by the cooling fan 78 are regulated as necessary; the power consumption and the noise of the laser printer 1 can be reduced greatly as compared with the case that the quantity and the velocity of the airflow are maximized.

The quantity and the velocity of the airflow generated by the cooling fan 78 are increased at the stage of which the print data is input. Resultantly, image forming can be started after motes and other objects likely to be adhered to the charging device 30 are effectively eliminated by use of the airflow.

Before the charging device 30 is driven, the quantity and the velocity of the airflow generated by the cooling fan 78 are increased. Therefore, the charging to the photosensitive drum 20 can be started after motes and other objects likely to be adhered to the charging device 30 are effectively eliminated by use of the airflow in advance. The cooling fan 78 turns at full speed to increase the quantity and the velocity of the airflow. Thus, motes and other objects can be eliminated from the charging device 30.

Even after the printing operation is completed, the quantity and the velocity of the airflow generated by the cooling fan 78 are maintained maximally for five seconds. Therefore, airborne motes and other objects around the charging device 30 can be eliminated even after the printing.

As the developing roller 59 is made of a conductive rubber, there is a possibility that the conductive rubber worn during the toner supply turns into tiny rubber scraps, which float in midair and adhere to the charging device 30. However, the quantity and the velocity of the airflow generated by the cooling fan 78 are maximized during the printing. Therefore, the rubber scraps generated in such a manner can be also eliminated.

In the above description, only the cooling fan 78 is used to generate the airflow, but it can be replaced with a fan exclusive for eliminating airborne motes more effectively. In this case, in addition to the cooling fan 78 intended for ejecting the heat outside, a small and low-cost fan that generates airflow to eliminate motes may be used, which can reduce the overall costs.

The above-mentioned warm-up is not performed only when the power is turned on. It is performed when the continuity to the heater of the heat roller 71 is suspended for power savings and a new print request is issued. Any arrangement is possible as long as the cooling fan 78 can turn at full speed even during such a warm-up.

The above refers to the case that both the quantity and the velocity of the airflow are increased or reduced as needed. However, either the quantity or the velocity may be increased or reduced as needed.

Although the invention has been described as embodied in a laser printer, it should be appreciated that the invention is applicable to any image forming apparatus that includes a charging device.

While this invention has been described in conjunction with the exemplary embodiments outlined above, it is evident that many alternatives, modifications, and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. An image forming apparatus, comprising:

a photosensitive member;

a charging device that charges the photosensitive member; and means for reducing motes adhered on the charging device, wherein the means for reducing motes includes charging amount control means for controlling a charging amount of the photosensitive member by the charging device and for reducing the charging amount during a standby period from the charging amount used during an image forming period and by controlling a charging ON time of the charging device wherein the charging ON time during the standby period is shorter than the charging ON time during the image forming period.

2. The image forming apparatus according to claim 1, wherein the charging amount control means controls a voltage applied to the charging device during the standby period by chopping control, to reduce the charging amount.

3. The image forming apparatus according to claim 2, wherein the charging amount control means equalizes a chopping on time and a chopping off time in the chopping control.

4. The image forming apparatus according to claim 1, wherein the charging amount control means reduces a charging current of the charging device during the standby period from a charging current used during the image forming period.

5. An image forming apparatus, comprising:

a photosensitive member;

a charging device that charges the photosensitive member;

means for receiving print data for image forming; and means for reducing motes adhered on the charging device, wherein the means for reducing motes includes a fan that generates airflow inside the image forming apparatus and fan control means for controlling a quantity of airflow generated by the fan, and the fan control means increases the quantity of airflow generated by the fan upon a reception of the print data.

6. The image forming apparatus according to claim 5, wherein the fan control means increases the quantity of airflow generated by the fan before the charging device starts to charge.

7. The image forming apparatus according to claim 6, wherein the fan control means reduces the quantity of airflow generated by the fan after the charging device finishes charging.

8. A method of forming an image using an image forming apparatus including a photosensitive member, comprising:

charging the photosensitive member using a charging device; and reducing motes adhered on the charging device by controlling a charging amount of the photosensitive member by the charging device, wherein the charging amount is reduced during a standby period from the charging amount used during an image forming period and by controlling a charging ON time of the charging device wherein the charging ON time during the standby period is shorter than the charging ON time during the image forming period.

9. The method according to claim 8, wherein a voltage applied to the charging device during the standby period is controlled by chopping control, to reduce the charging amount.

10. The method according to claim 9, wherein a chopping on time and a chopping off time in the chopping control are equalized.

11. The method according to claim 8, wherein a charging current of the charging device is reduced during the standby period from a current used during the image forming period.

12. A method of forming an image using an image forming apparatus including a photosensitive member, comprising:

charging the photosensitive member using a charging device;

receiving print data for image forming; and reducing motes adhered on the charging device by generating an airflow inside the image forming apparatus and controlling a quantity of the airflow generated, wherein the quantity of airflow generated is increased upon a reception of the print data.

13. The method according to claim 12, wherein the quantity of airflow generated is increased before the charging device starts to charge.

14. The method according to claim 13, wherein the quantity of airflow generated is reduced after the charging device finishes charging.

15. A method of forming an image using an image forming apparatus including a photosensitive member, comprising:

charging the photosensitive member using a charging device; and reducing motes adhered on the charging device by controlling a charging amount of the photosensitive member by the charging device, generating an air flow inside the image forming apparatus and controlling a quantity of the air flow generated, wherein the charging amount is reduced during a standby period from the charging amount used during an image forming period and by controlling a charging ON time of the charging device wherein the charging ON time during the standby period is shorter than the charging ON time during the image forming period.

16. The method according to claim 15, wherein a voltage applied to the charging device during the standby period is controlled by chopping control, to reduce the charging amount.

17. The method according to claim 16, wherein a chopping on time and a chopping off time in the chopping control are equalized.

18. The method according to claim 15, wherein a charging current of the charging device is reduced during the standby period from a current used during the image forming period.

19. A method of forming an image using an image forming apparatus including a photosensitive member, comprising:

charging the photosensitive member using a charging device;

reducing motes adhered on the charging device by controlling a charging amount of the photosensitive member by the charging device, generating an air flow inside the image forming apparatus and controlling a quantity of the air flow generated; and receiving print data for image forming, wherein the quantity of airflow generated is increased upon a reception of the print data.

20. The method according to claim 19, wherein the charging amount is reduced during a standby period from the charging amount used during an image forming period and by controlling a charging ON time of the charging device wherein the charging ON time during the standby period is shorter than the charging ON time during the image forming period.

21. The method according to claim 19, wherein the quantity of airflow generated is increased before the charging device starts to charge.

22. The method according to claim 19, wherein the quantity of airflow generated is reduced after the charging device finishes charging.

* * * * *